US007632195B2

(12) United States Patent
Jorgensen

(10) Patent No.: US 7,632,195 B2
(45) Date of Patent: Dec. 15, 2009

(54) GOLF CLUB HEAD WITH LOW DENSITY CROWN

(75) Inventor: Douglas C. Jorgensen, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 211 days.

(21) Appl. No.: 11/203,148

(22) Filed: Aug. 15, 2005

(65) Prior Publication Data

US 2007/0037632 A1 Feb. 15, 2007

(51) Int. Cl.
*A63B 53/04* (2006.01)

(52) U.S. Cl. ..... 473/345; 473/348; 473/349; 473/350

(58) Field of Classification Search ..... 473/323–350
See application file for complete search history.

(56) References Cited

U.S. PATENT DOCUMENTS 5,547,427 A 8/1996 Rigal et al. ..... 473/345
5,624,331 A 4/1997 Lo et al. ..... 473/345
6,162,133 A 12/2000 Peterson ..... 473/345
6,558,271 B1 5/2003 Beach et al. ..... 473/327
6,872,152 B2 3/2005 Beach et al. ..... 473/324
2005/0272527 A1* 12/2005 Sugimoto ..... 473/345
2006/0052181 A1* 3/2006 Serrano et al. ..... 473/345

* cited by examiner

*Primary Examiner*—Alvin A Hunter
(74) *Attorney, Agent, or Firm*—Hanify & King, P.C.

(57) ABSTRACT

A golf club head and a method for forming a golf club head are disclosed. The golf club head may include a low density portion and a high density portion. The high density portion includes at least a sole, a face, and at least one support member. The support member is operatively connected to the face and the sole, and maintains the structural integrity of the golf club head. The low density portion comprises the crown and the skirt of the club head. When the low density portion is attached to the at least one support member, a golf club head may be formed. In this manner, the center of gravity of the club head may be lowered and moved away from the face of the club.

19 Claims, 7 Drawing Sheets

GOLF CLUB HEAD WITH LOW DENSITY CROWN

FIELD OF THE INVENTION

The present invention relates to a golf club head comprising low and high density materials. More specifically, the present invention relates to a golf club head with a center of gravity that may be manipulated based on the low and high density materials.

BACKGROUND OF THE INVENTION

Typically, a golf club has two main parts, the shaft and the head. The shaft and head for each type of club, i.e., metal- or wood-type clubs, including drivers and fairway clubs, iron-type clubs, including wedges, utility- or specialty-type clubs, and putter-type clubs, may have different properties. When manufacturing many of these club heads, it is desirable to design the head such that the center of gravity is lowered and moved towards the back of the club head, i.e., away from the face. Lowering the center of gravity of a club head increases the vertical component of the force vector imparted to the ball at impact, resulting in a desired ball flight trajectory. Furthermore, moving the center of gravity towards the back of the club head causes the club to be more forgiving and playable. In other words, any negative effect on the trajectory of a golf ball is minimized or eliminated when the ball is struck away from the center of the club face.

Golf club designers have attempted to move the center of gravity lower and towards the back of the club head using a variety of technologies. For instance, designers often add weights to selected portions of the head to manipulate the center of gravity. Alternately, designers have attempted to manipulate the distribution of the amount of material in various parts of the head, e.g., more material is placed towards the bottom and back of the club head. Adding weights to a club head, however, may cause it to become heavy and unwieldy, possibly to the point of limiting a golfer's swing speed and adversely affecting the golfer's swing mechanics. Similarly, manipulating the distribution of material may result in a club head that cannot withstand the stress of repeated impacts with a golf ball that occur during normal use of the resulting golf club. Moreover, designers have also attempted to manipulate the weight distribution using low density materials, although these materials have only been placed at the crown of the club head.

Therefore, there is a continuing need for a golf club head and a method of manufacturing a golf club head having an optimally positioned center of gravity while maintaining the structural integrity of the club head.

SUMMARY OF THE INVENTION

According to one aspect, the present invention comprises a golf club head that includes a first portion including a sole, a face, and a support member extending from an upper portion of the face to a rear portion of the sole. The club head also includes a second portion comprising a crown and a skirt coupled to the sole, the face, and the support member. The second portion is preferably formed of a low density material, which may be formed of one or more of magnesium, thermal plastic, and a composite material. It is desirable for between about 50% and about 95% of the crown and the skirt to be formed of the low density material.

Preferably, the support member corresponds to the outer perimeter of the crown and the skirt of the golf club head. The second portion, which attaches to the support member, may comprise two or more pieces. In order to assist in the placement of the center of gravity, the ratio of the density of the first portion to the density of the second portion is about 3:1 or greater. In this manner, the second portion comprises less than about 5% of the total weight of the club head.

According to another aspect, the present invention comprises a golf club head that includes a face, at least two support members, and a sole, each comprising a material having a first density. Furthermore, the club head includes a crown and skirt, each comprising a material having a second density, wherein the crown and skirt are operatively connected to the at least two support members. Preferably, at least 95% of the crown and skirt are formed by the material having a second density.

The second density is preferably greater than the first density. Accordingly, the material having the second density may comprise at least one of magnesium, thermal plastic, and composite material. Thus, the ratio of the first density to the second density may preferably be about 2:1 or greater, or more preferably about 3:1 or greater.

In one embodiment, the crown and skirt may be formed such that they comprise less than about 5% of the total weight of the golf club head. However, a portion of the crown and skirt may comprise a metallic material to, for example, provide structural support. At least one weight may optionally be attached to the sole to aid in the placement of the center of gravity.

According to yet another aspect, the present invention includes a method for forming a golf club head. The method preferably includes forming a first portion comprising a sole, a face, and one or more support members. The support members are preferably formed such that they extend from the face to a rear portion of the sole. Weights may be optionally attached to the sole as desired.

A second portion comprising a crown and a skirt may be formed of a low density material. The second portion may then be inserted through the face, and then forced into contact with the one or more support members using a mechanical insertion device, e.g., a bladder or a jack. To aid in connecting the second portion to the first portion, an adhesive may be applied to selected areas of the second portion and the one or more support members. After the second portion has been connected to the first portion, a face plate may be attached to the face.

BRIEF DESCRIPTION OF THE DRAWINGS

Further features and advantages of the invention can be ascertained from the following detailed description that is provided in connection with the drawings described below.

DETAILED DESCRIPTION OF THE PREFERRED EMBODIMENTS

Figure 1:
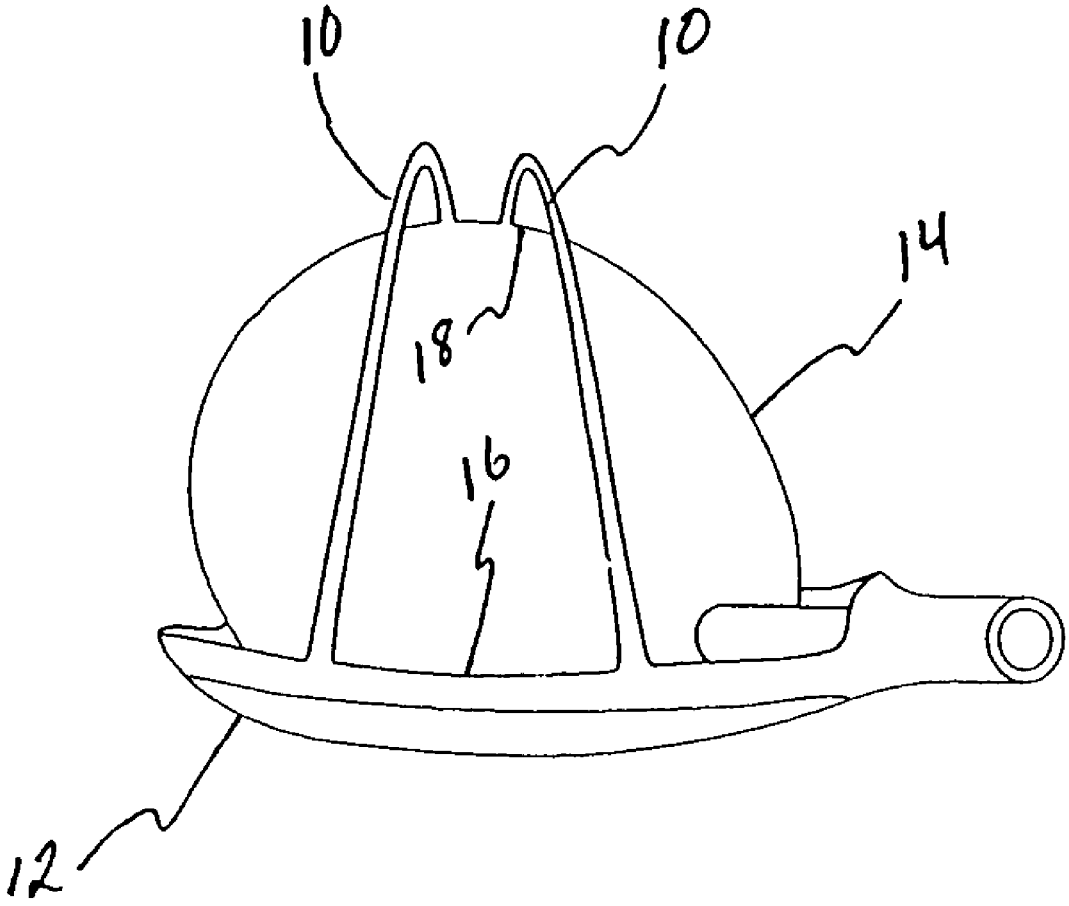
FIG. 1 shows a top view of a portion of one embodiment of a golf club head according to the present invention.

Golf equipment designers are constantly manipulating the shape, size, and materials used to manufacture clubs and balls. With regard to golf clubs, designers manipulate the shape, size, and materials used in order to construct a golf club such that the center of gravity is moved lower and towards the back of the club. In the past, this has been accomplished by adding weights to different portions of the club head, including the inner volume of the club head. Alternately, the amount of material and its distribution in the club head has been manipulated to lower the center of gravity.

The present invention relates to an improved golf club head and method for constructing a golf club head. In one embodiment, the golf club head of the present invention includes a high density portion and a low density portion. As used herein, "high density" is used for purposes of distinguishing the different portions of the club head. It need not be made of a high-density material. Preferably, the high density portion comprises the sole, face, and one or more support members. The one or more support members are preferably operatively connected to the face and the sole. The low density portion comprises the crown and the skirt of the club head, which are preferably formed from a high strength, low density material.

The present invention may also include a face plate constructed out of either high density or low density material. Weights may optionally be added to the inner or outer surface of the sole in order to further manipulate and position the center of gravity. Alternately, the sole may include one or more cavities that are capable of accommodating inserts having variable weights. Finishing touches, e.g., painting and sanding, may optionally be performed for aesthetic purposes.

The High Density Portion

The present invention can be applied to any type of club head, such as drivers, woods, hollow irons, and the like. The club head may be formed by any means known to those skilled in the art. For instance, portions of the club head may be formed from cast, forged, stamped, or molded components. Any material known to those skilled in the art may be used including, but not limited to, iron, steel, aluminum, tin, vanadium, chromium, cobalt, nickel, or alloys. However, the high density portion of the head is preferably formed of a metal such as titanium. In a preferred embodiment, the face, the sole, the face plate, and the support members may be forged from a high strength titanium alloy such as 10-2-3 (Ti-10% V-2% Fe-3% Al) or 15-3-3-3 (Ti-15% V-3% Cr-3% Sn-3% Al), or stamped from as-rolled sheet stock. Alternatively, the high density portion may be cast. In another embodiment, the face, the sole, the face plate, and/or the support members may be produced from a different titanium alloy such as a 6-4 alloy (Ti-6% Al- -4% V).

In alternate embodiments, other forging and casting alloys may be used, such as stainless steel and aluminum. By forming the face plate by stamping, forging, or casting, the face portion may be thin yet still have sufficient strength to withstand repeated impact with a golf ball without failure. In turn, by forming the face portion as thin as possible while still meeting the desired mechanical performance standards, weight may be redistributed to other parts of the club head.

In order to lower the center of gravity as much as possible, it is desirable to maximize the ratio of the density of the high density portion to the density of the low density portion of the club head. Preferably, the ratio of the density of the high density portion to the density of the low density portion is about 2:1 or greater. More preferably, the ratio of the density of the high density portion to the density of the low density portion is about 3:1 or greater. Most preferably, the ratio of the density of the high density portion to the density of the low density portion is about 5:1 or greater.

In one embodiment, the high density portion of the club head may be formed as one piece, or as several pieces that may be fixed together in a variety of manners, such as welding, using an adhesive, e.g., glue, or a bonding process, e.g., molding the pieces together using heat. Preferably, however, the high density portion is formed as one piece. One advantage of forming the high density portion in one piece is that the manufacturing process may be simplified and streamlined, resulting in a reduction in manufacturing errors and manufacturing time, as well as a cost reduction.

According to one aspect of the present invention, the high density portion that is formed as one piece includes the sole, face, and the support members. The face plate and any other components, such as weights, that are added to the club head may be manufactured using the same processes, but as separate pieces. One advantage of manufacturing the face plate as a separate piece is that the low density pieces may be inserted through the face, thereby facilitating the manufacturing of the club head and allowing for a variety of construction methods.

FIG. 1 shows a portion of a golf club head of the present invention. In the illustrated embodiment, this high density portion includes a sole 14, and face 12, and one or more support members 10. With reference to FIG. 1, the support members are described. In one embodiment, the support members 10 are preferably formed as part of the face 12 and the sole 14, i.e., the face 12, sole 14, and support members 10 are formed as one piece. In other embodiments, the support members 10 may be formed as separate elements. In such an embodiment, the support members 10 can be coupled to the sole 14 and the face 12 in a variety of manners with welding being one preferred manner.

It is desirable for the support members 10 to generally follow the periphery of the crown and skirt of the club head, i.e., the profile of the club head formed by the skirt and crown may be limited by the support members 10. In other words, the support members 10 form a portion of the outer surface area of the crown and skirt. Thus, the low density portion described below may not enclose the support members 10.

With regard to the positioning of the support members 10, it is desirable for them to originate at the portion of the face near the crown 16 and terminate at a rear portion of the sole 18 opposite the face 12. However, the support members 10 are not limited to originating and terminating at any specific area; they may originate at any portion of the face 16 and may terminate at any portion of the sole 18.

The support members 10 may be oriented as desired. In the illustrated embodiment of FIG. 1, the support members 10 are positioned to generally trifurcate the low and high density coupling surface along the face 12. The support members 10 may be parallel or, as illustrated, non parallel.

The number of support members 10 may be varied as desired. The number of support members may also be chosen based on the amount of support required to prevent the club head from deforming during impact with an object. The amount of support required could depend on, for example, the materials used to form the club head. Preferably, the present invention includes between about 1 and about 6 support members. More preferably, the present invention includes between about 1 and about 5 support members, and most preferably the present invention includes between about 2 and about 4 support members. Any ranges provided herein include the lower and upper boundaries.

The properties of the support members 10, i.e., their size, profile, thickness, and the like, may also be varied. However, skilled artisans will recognize that the properties of the support members 10 may be chosen based on the overall desire to lower the center of gravity of the club head. In other words, it is desirable for the properties of the support members 10 to be chosen such that they have sufficient structural integrity to provide support for the high and the low density portions, while also minimizing their weight impact near the crown and skirt of the club. Accordingly, the support members 10 preferably comprise about 10% or less of the crown and the skirt. More preferably, the support members 10 comprise about 5% or less of the crown and the skirt. Most preferably, the support members 10 comprise about 2% or less of the crown and the skirt.

Preferably, the support member 10 profile is formed such that the low density portion can easily engage with it, i.e., the profile of the support member 10 should have a surface that is capable of engaging snugly with a corresponding portion of the low density portion. In other words, the profile of the support member 10 should be chosen such that the surface contact between it and a corresponding low density portion may be maximized. Thus, it may not be desirable for the profile to include irregular surfaces. Rather, it may be desirable for the support members 10 to comprise a round surface. In other embodiments it may be desirable for the support members 10 to comprise one or more flat surfaces. In this manner, the surface contact between the support member 10 and the low density portion may be maximized because their surfaces are flush with each other, thereby minimizing the chance of an impact causing a separation between the two.

Figure 2A:
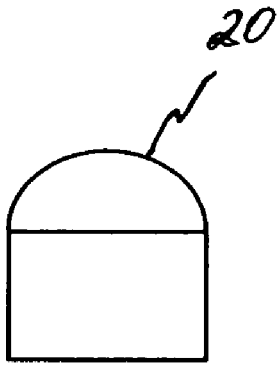
FIGS. 2A-2D show cross-sections of exemplary support members according to one embodiment of the present invention.
Figure 2B:
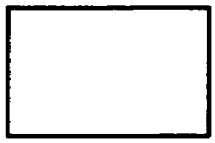
Figure 2C:
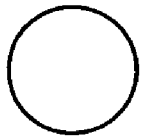
Figure 2D:
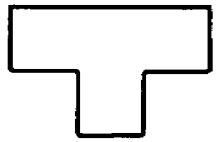

For instance, in one embodiment the profile of the support member 10 may comprise three or more flat surfaces, as shown in FIGS. 2A, 2B and 2D. In some embodiments, it may be desirable for the top surface 20 of the support member 10 to be rounded for aesthetic purposes. Alternately, it may be desirable for the top surface to be flat, as shown in FIG. 2B, so that it lies flush with the low density portion that forms the crown of the club head. In another embodiment, the profile of the support member may be circular, as shown in FIG. 2C. In other embodiments, the profile may have multiple flat surfaces, as shown in FIG. 2D.

Regardless of its profile, the support member 10 may include one or more recesses 22 that correspond to one or more protrusions formed on the low density portion of the club head. A recess 22 may assist in the placement of the low density portion. Additionally, in conjunction with the corresponding protrusion on the low density portion, the recess 22 may aid in restricting the relative movement between the support member 10 and the low density portion. Thus, the bond between the support member 10 and the low density portion may be further strengthened.

Figure 3A:
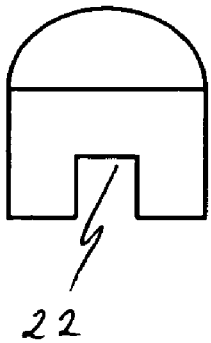
FIGS. 3A-3C show the exemplary support members of FIGS. 2A-2D in more detail.
Figure 3B:
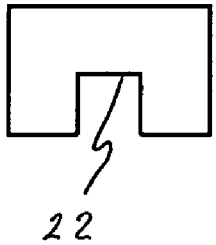
Figure 3C:
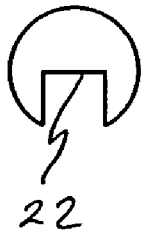

The recess 22 may comprise any size, shape, and depth. Moreover, the recess 22 may be formed in any portion of the support member 10. However, it is preferable for the recess 22 to be formed in a bottom portion of the support member 10, as shown in FIGS. 3A-3C. As described below, the low density portion of the club may be inserted through the face using a mechanical insertion device, e.g., a bladder or jack fixture. Thus, the low density portion would be forced upwards into engagement with the support members 10. Therefore, one advantage of forming the recess 22 in the bottom portion of the support member 10 is that the placement of the low density portion may be facilitated by engaging the protrusion with the recess 22 as it is being forced upward.

The recess 22 may be formed such that its opening is slightly smaller than the protrusion formed on the low density portion. By applying a small amount of force, the protrusion is preferably capable of deforming the opening slightly, allowing it to be forced into the recess 22. Once the protrusion has been inserted into the recess 22, the opening of the recess 22 restricts the protrusion from dislodging unless a force is applied. When used in combination with an adhesive, a recess 22 formed in this manner provides an additional way to prevent the low density portion from being disengaged from the support member 10.

Figure 4:
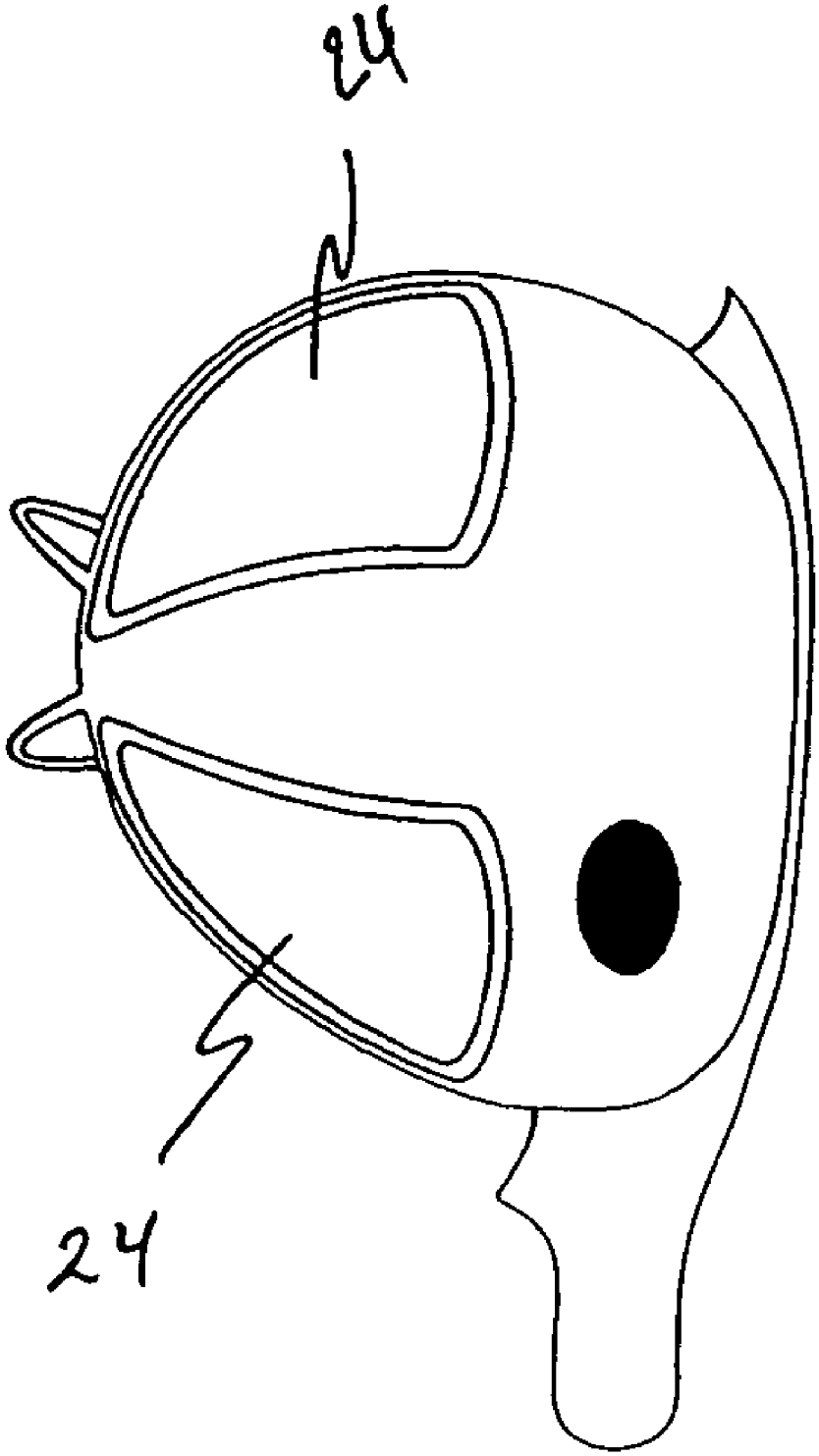
FIG. 4 shows a sole view of a portion of one embodiment of a golf club head according to the present invention.

In one embodiment, the sole 14 may include weights 24 that aid in shifting the center of gravity towards the back of the club, as shown in FIG. 4. A center of gravity that is positioned towards the back of the club is desirable because it makes the golf club more forgiving, i.e., the trajectory of the ball is less likely to be negatively affected when the ball is not struck by the center of the face. The weights 24 that are added to the sole 14 may be external, i.e., they may be attached to the bottom surface of the sole 14. Alternately, the sole 14 may be manufactured such that it includes small cavities into which one or more weights 24 may be inserted. In either embodiment, the weight 24 may be fastened to the bottom surface of the sole 14 using any adhesive or mechanical means known to those skilled in the art. In other embodiments, the weights 24 may be internal, i.e., they may be fastened to the inner surface of the sole 14, within the inner volume of the club head.

The Low Density Portion

The low density portion of the club head that forms the crown and skirt may comprise any material known to those skilled in the art. For example, low density, high strength materials such as magnesium, thermal plastics, and composites including, for example, carbon fiber may be used. Alternately, a combination of two or more low density materials can be used. The low density, high strength materials provide the dual advantage of providing support while minimizing the weight impact of the crown and skirt.

Similar to the high density portion of the club, the low density portion of the club head may also be formed as one or more pieces. In one embodiment, it may be desirable for the low density portion to comprise several pieces to facilitate the insertion and installation of the pieces through the face 12. This provides the advantage of allowing the pieces to be pressed into position with a mechanical insertion device such as a bladder, jack fixture, or the like. Preferably, the low density portion comprises about 5 pieces or less. More preferably, the low density portion comprises about 3 pieces or less.

Figure 5:
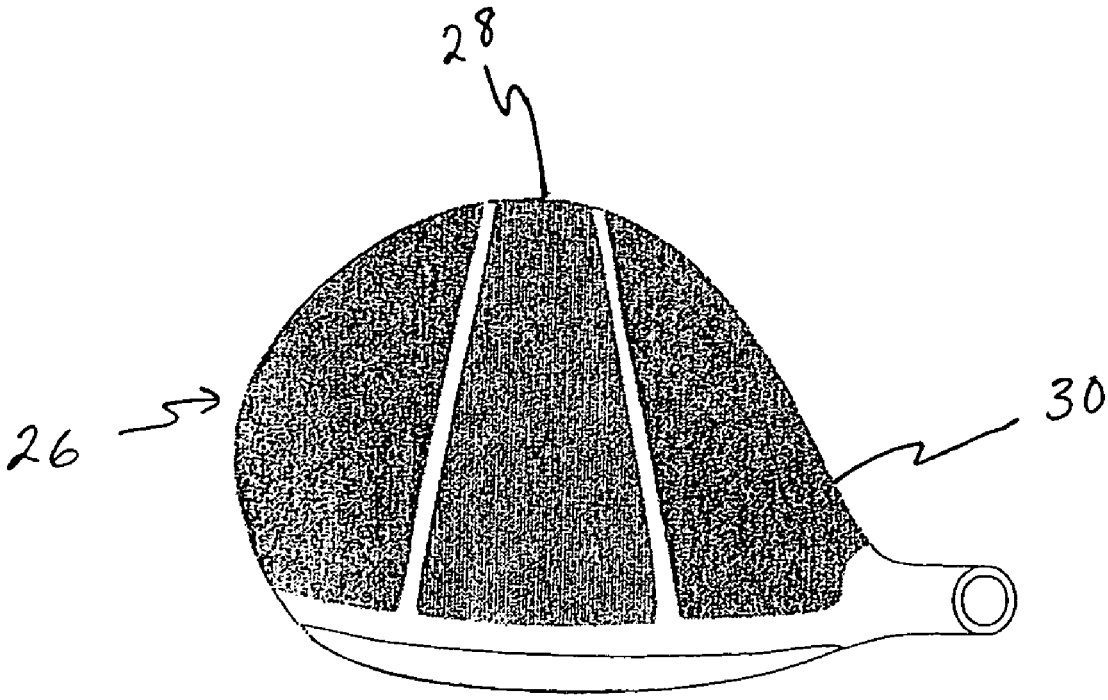
FIG. 5 shows a top view of one embodiment of a golf club head according to the present invention.
Figure 6:
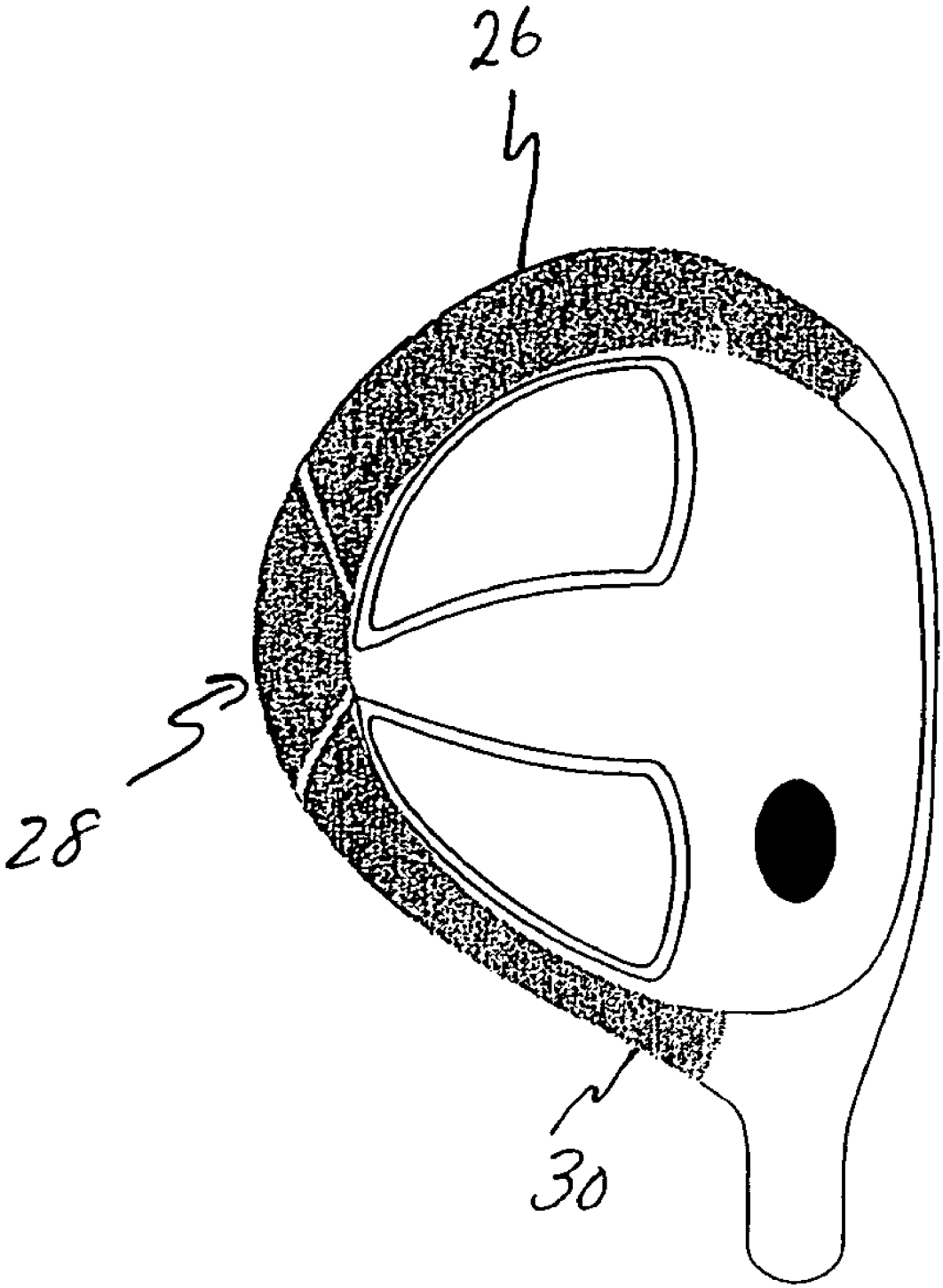
FIG. 6 shows a sole view of one embodiment of a golf club head according to the present invention.
Figure 7A:
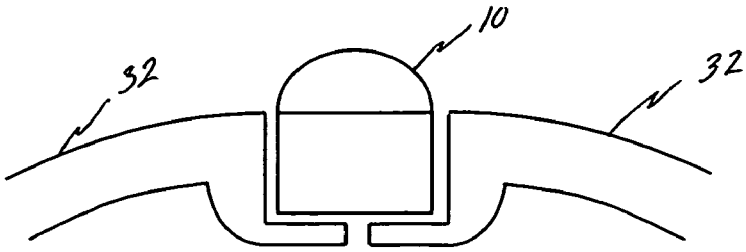
FIGS. 7A-7G show several embodiments of the mating surfaces of the low density portion and the support members of a golf club head according to the present invention.
Figure 7B:
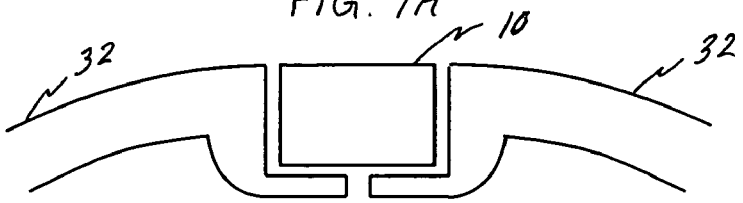
Figure 7C:
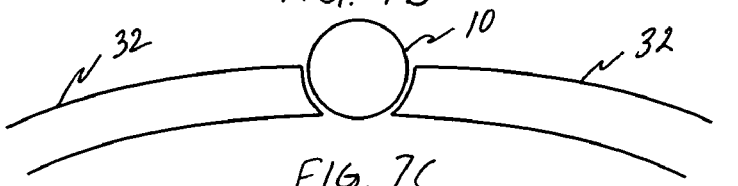
Figure 7D:
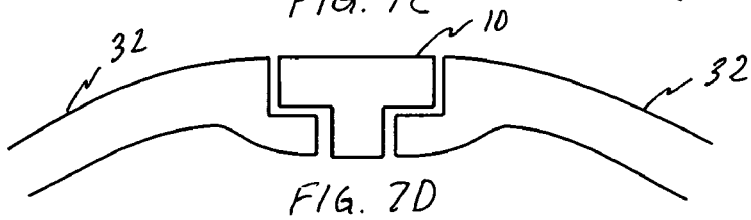
Figure 7E:
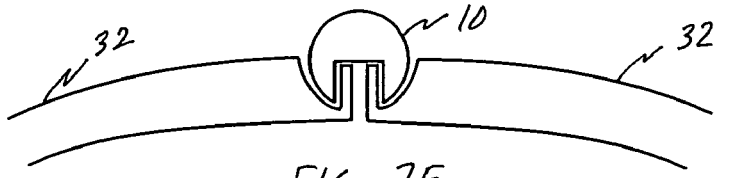
Figure 7F:
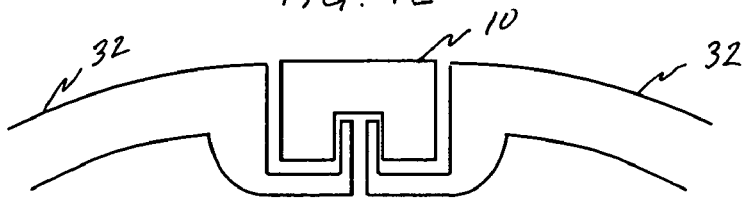
Figure 7G:
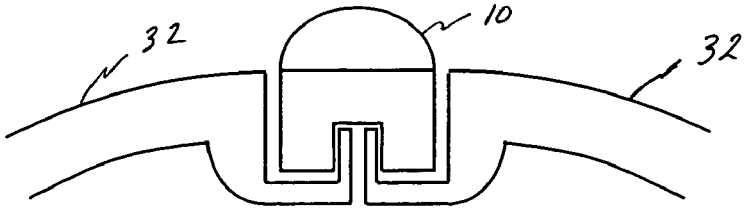

As shown in the exemplary embodiment illustrated in FIGS. 5 and 6, the low density portion comprises three pieces, i.e., a toe piece 26, a middle piece 28, and a heel piece 30. Each piece includes a crown portion and a skirt portion. As mentioned above, forming the crown and skirt from a low density material lowers the club head center of gravity because the majority of the weight of the club head is concentrated in the sole 14. In some embodiments, the low density pieces 226, 28, and 30 may include a portion that is formed from a high density material, e.g., a metallic material, in order to provide structural support. The metallic portion of the crown, for example, may come into contact with a golf ball during a swing.

The shape of the low density pieces may also be varied as desired. For example, the shape of the pieces may depend on how the support members 10 are formed. Alternately, the support members 10 may be based on the shape of the low density pieces. Preferably, each piece of the low density portion is capable of being inserted through the face 12.

It is desirable for the low density portion of the club head to comprise a small percentage of the total weight of the club head. Accordingly, it is preferable for the crown and skirt to comprise about 20% or less of the total weight of the club head. More preferably, the combination of the crown and skirt comprises about 10% or less of the total weight of the club head. Most preferably, the combination of the crown and skirt comprises about 5% or less of the total weight of the club head.

In another embodiment, the low density portion of the club head preferably comprises between about 1% and about 20% of the total weight of the club head. More preferably, the low density portion of the club head comprises between about 2% and about 15% of the total weight of the club head. Most preferably, the low density portion of the club head comprises between about 5% and about 10% of the total weight of the club head.

Another way to characterize the weight of the low density portion of the club head is relative to the weight of the high density portion. Accordingly, it may be preferable for the ratio of the weight of the high density portion to the weight of the low density portion of the club head to be between about 100:1 and about 20:1. More preferably, the ratio of the weight of the high density portion to the weight of the low density portion of the club head is between about 90:1 and about 40:1. Most preferably, the ratio of the weight of the high density portion to the weight of the low density portion is between about 75:1 and about 60:1.

According to one aspect of the present invention, the low density portion of the club head comprises the skirt and crown of the club head. Thus, the low density portion of the club head preferably comprises between about 30% and about 60% of the total outer surface area of the club head. More preferably, the low density portion comprises between about 40% and about 55% of the total outer surface area, and most preferably the low density portion comprises between about 45% and about 55% of the total outer surface area of the club head.

The majority of the crown and the skirt are preferably formed from a low density material. Preferably, at least 85% of the crown and the skirt of the club head are formed from the low density material. More preferably, at least 95% of the crown and the skirt are formed from the low density material. Most preferably, at least 98% of the crown and the skirt are formed from the low density material.

In another embodiment, between about 35% and about 100% of the crown and the skirt of the club head are formed from the low density material. More preferably, between about 70% and about 100% are formed from the low density material, and most preferably between about 80% and about 100% are formed from the low density material.

As described above, the shape of the support members 10 and the low density pieces may be varied. The shape of the support members 10 and the area of the low density pieces that contact the support members 10 may be chosen such that they correspond to maximize the surface contact between the two. For instance, in one embodiment the support members 10 may have a rectangular shape, as shown in FIGS. 7A-7G. The low density pieces 32 preferably have flat surfaces that correspond to the rectangular shape of the support member 10. In such an embodiment, the low density pieces 32 preferably engage with the bottom and side portion of the support member 10. Although not shown in FIGS. 7A-7G, the low density pieces 32 may have one or more protrusions and the support member 10 may have corresponding recesses to aid in securing the two together, as described above. To further aid in securing the low density pieces 32 and the support member 10, an adhesive may be applied to selected areas of the low density pieces 32 and the support members 10 to aid in fastening them together. Any adhesive known to those skilled in the art may be used. These may include, but are not limited to, glue, epoxy, resins, and the like. Of course, skilled artisans will recognize that this embodiment is only one example of how the low density pieces 32 and the support members 10 may be fastened together. Other shapes and mating surfaces may be used as desired according to a particular application.

Exemplary Methods of Construction

Figure 8:
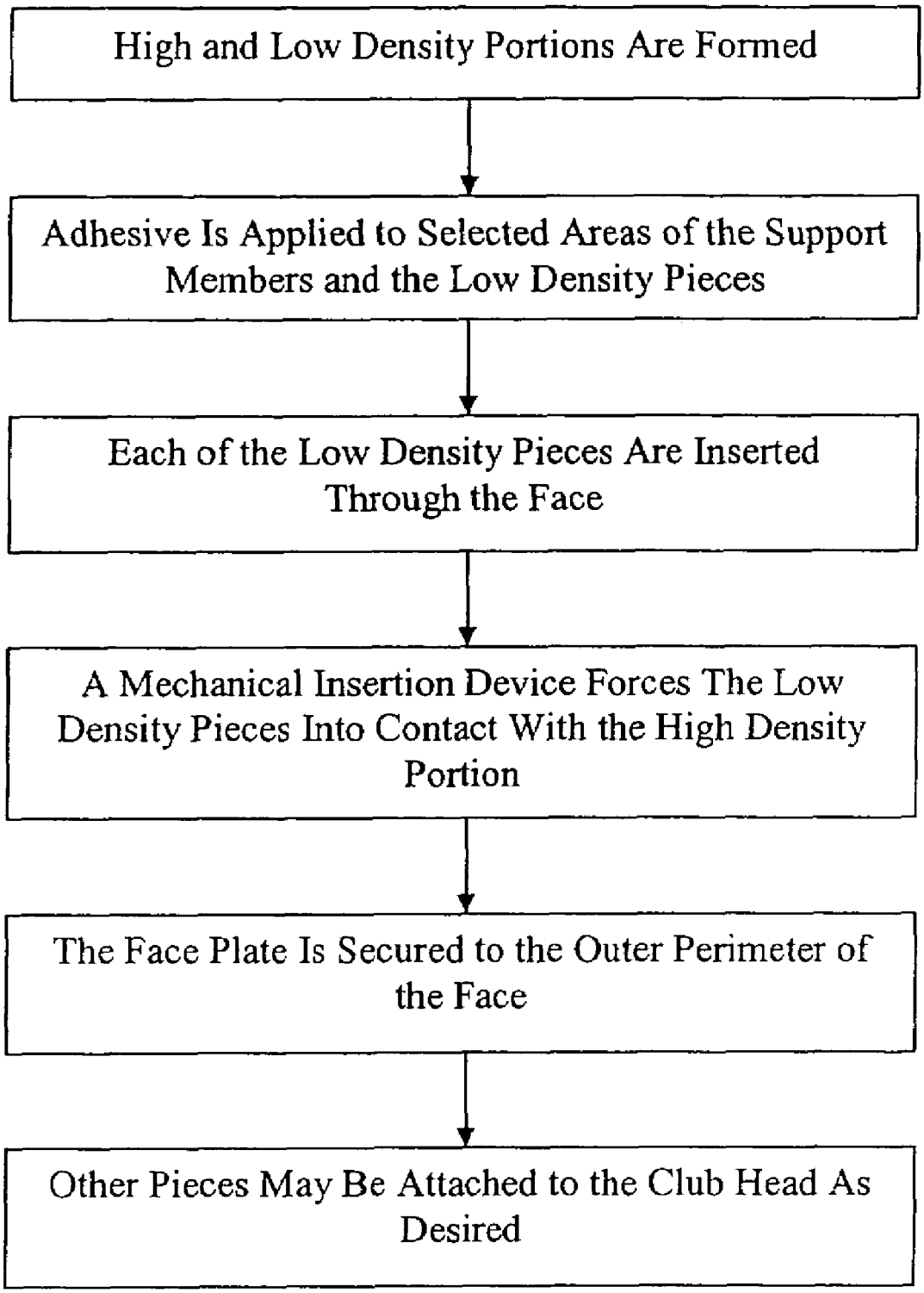
FIG. 8 is a flow chart showing exemplary steps in the construction of a golf club head according to one embodiment of the present invention.

According to another aspect, the present invention includes a method for forming a golf club head from low density and high density portions. This aspect is described with respect to FIG. 8, which is a flow chart showing exemplary steps in the construction of a golf club head according to one embodiment of the present invention. In one embodiment, the method comprises forming the high density and low density portions of the golf club. The formation of the high density pieces may include attaching weights to the inner or outer surface of the sole, as described above. Once this is completed, the low density portions of the golf club are inserted through the face 12 of the high density portion. The low density pieces may be inserted at the same or different times. Though the low density pieces may be inserted manually, the insertion process is preferably automated. After the low density pieces have been inserted and positioned as desired, the face plate is then attached to the face 12.

An adhesive may be applied to the support members 10 and the corresponding area of the low density pieces. The adhesive is preferably applied before the low density pieces are inserted through the face 12, although it may be done after the pieces have been inserted. Once the low density pieces have been inserted, a mechanical insertion device such as a bladder or jack fixture may be inserted beneath the pieces. When the mechanical insertion device is in place, it is preferably activated, i.e., a bladder may be inflated and a jack fixture may be extended, to force the low density pieces into contact with the support members 10, sole 14, and face 12.

The mechanical insertion device may remain in its activated state, i.e., forcing contact between the low and high density portions, for a predetermined amount of time. Preferably, the mechanical insertion device remains in its activated state between about 5 seconds and about 60 seconds. More preferably, the mechanical insertion device remains in its activated state between about 10 seconds and about 20 seconds. One or more thermal cycles may be applied to ensure proper bonding.

After the predetermined amount of time has elapsed, the mechanical insertion device may be removed from the club head. The face plate may then be fastened to the face 12 using an adhesive and/or a molding process. Other pieces may then be attached to the club head, such as a shaft, inserts, hosels, insulating materials, and the like. Those skilled in the art will recognize that this is just one example of how the club head according to the present invention can be constructed. Other steps may be added, the sequence of steps may be altered, and other mechanical insertion devices known to those skilled in the art may be used. Accordingly, the present invention is not intended to be limited to the aforementioned method of construction.

In another embodiment, a mechanical insertion device such as a bladder or jack fixture may be used to secure one or more uncured low density pieces in place. For instance, in a preferred embodiment a bladder may be inserted into the interior volume of the high density portion and expanded. Uncured low density pieces 26, 28, and 30 may then be inserted on top of the expanded bladder, and a mold top may be placed atop the low density pieces 26, 28, and 30 and the support members 10. The head may then undergo thermal cycling to bond the low density pieces to the high density portion. After a predetermined amount of time, the mold top may be removed, and the bladder may be deflated and extracted. In this manner, the low density pieces may be combined with the high density portion to form the crown and the skirt of the club head.

Although the present invention has been described with reference to particular embodiments, it will be understood to those skilled in the art that the invention is capable of a variety of alternative embodiments within the spirit of the appended claims.

The invention claimed is:

1. A golf club head, comprising:

a first portion including a sole, a face, and an elongate support member extending from an upper portion of the face to a rear portion of the sole; and a second portion including a crown and a skirt coupled to the sole, the face, and the support member, the second portion formed of a low density material;

wherein:

the low density material is formed of one or more of magnesium, thermal plastic, and a composite material;

between about 50% and about 90% of the crown and the skirt are formed of the low density material;

wherein the support member includes one or more recesses that correspond to one or more protrusions formed in the second portion.

2. The golf club according to claim 1, wherein the support member corresponds to the outer perimeter of the crown and the skirt of the golf club head.

3. The golf club according to claim 1, wherein the second portion comprises two or more pieces.

4. The golf club according to claim 1, wherein the ratio of a density of the first portion to a density of the second portion is about 3:1 or greater.

5. The golf club according to claim 1, wherein the second portion comprises less than about 5% of the total weight of the golf club head.

6. The golf club head of claim 1, wherein the support members comprise about 10% or less of the crown and the skirt.

7. The golf club head of claim 1, wherein the support members comprise about 5% or less of the crown and the skirt.

8. The golf club head of claim 1, wherein the support members comprise about 2% or less of the crown and the skirt.

9. The golf club of claim 1, wherein the support member originates at about a center portion of the upper portion of the face and terminates at about a center portion of the rear portion of the sole.

10. The golf club of claim 1, wherein the support member originates between a center point of the upper portion of the face and a toe area of the upper portion of the face, and the support member terminates at about the center of the rear portion of the sole.

11. The golf club of claim 1, wherein the support member originates between a center point of the upper portion of the face and a heel area of the upper portion of the face, and the support member terminates at about the center of the rear portion of the sole.

12. The golf club head of claim 1, wherein the support member forms a portion of an outer surface of the club head.

13. A golf club head, comprising:

a first portion including a sole, a face, and a support member extending from an upper portion of the face to a rear portion of the sole; and a second portion including a crown and a skirt coupled to the sole, the face, and the support member, the second portion formed of a low density material;

wherein:

the low density material is formed of one or more of magnesium, thermal plastic, and a composite material;

between about 50% and about 90% of the crown and the skirt are formed of the low density material; and the support member originates at about a center portion of the upper portion of the face and terminates at about a center portion of the rear portion of the sole.

14. The golf club head of claim 13, wherein the support member forms a portion of an outer surface of the club head.

15. The golf club head of claim 13, wherein the support member comprises about 2% or less of the crown and the skirt.

16. A golf club head, comprising:

a first portion including a sole, a face, and a first support member extending from an upper portion of the face to a rear portion of the sole; and a second portion including a crown and a skirt coupled to the sole, the face, and the first support member, the second portion formed of a low density material;

wherein:

the low density material is formed of one or more of magnesium, thermal plastic, and a composite material;

between about 50% and about 90% of the crown and the skirt are formed of the low density material; and the first support member originates between a center point of the upper portion of the face and a toe area of the upper portion of the face, and the first support member terminates at about the center of the rear portion of the sole.

17. The golf club head of claim 16, further comprising a second support member that originates between a center point of the upper portion of the face and a heel area of the upper portion of the face, and the second support member terminates at about the center of the rear portion of the sole.

18. The golf club head of claim 16, wherein the first and second support members comprise about 5% or less of the crown and the skirt.

19. The golf club head of claim 16, wherein the first and second support members form a portion of the outer surface of the club head.

* * * * *